US009994362B2

(12) United States Patent
Hoskins

(10) Patent No.: US 9,994,362 B2
(45) Date of Patent: Jun. 12, 2018

(54) CLOSURES FOR BLADDER PORTS

(71) Applicant: TSI Manufacturing, LLC, Bend, OR (US)

(72) Inventor: Matthew Hoskins, Bend, OR (US)

(73) Assignee: TSI Manufacturing, LLC, Bend, OR (US)

( * ) Notice: Subject to any disclaimer, the term of this patent is extended or adjusted under 35 U.S.C. 154(b) by 0 days. days.

(21) Appl. No.: 15/177,610

(22) Filed: Jun. 9, 2016

(65) Prior Publication Data

US 2016/0362229 A1 Dec. 15, 2016

Related U.S. Application Data

(60) Provisional application No. 62/172,967, filed on Jun. 9, 2015.

(51) Int. Cl.

| | |
|---|---|
| ***B65D 33/16*** | (2006.01) |
| ***B65D 25/02*** | (2006.01) |
| ***B65D 81/05*** | (2006.01) |
| ***B65D 5/49*** | (2006.01) |

(52) U.S. Cl.

CPC ..... *B65D 25/02* (2013.01); *B65D 5/48026* (2013.01); *B65D 81/055* (2013.01)

(58) Field of Classification Search

CPC ... B65D 25/02; B65D 5/48026; B65D 81/055
USPC ..... 383/80
See application file for complete search history.

(56) References Cited

U.S. PATENT DOCUMENTS

| | | | | |
|---|---|---|---|---|
| 7,063,243 | B2 | 6/2006 | Forsman et al. | |
| 7,448,509 | B2 | 11/2008 | Yang | |
| 7,600,656 | B2 | 10/2009 | Karl et al. | |
| D605,942 | S | 12/2009 | Miksovsky | |
| 8,622,229 | B2 * | 1/2014 | Lane | B65D 43/26 215/245 |
| D767,390 | S | 9/2016 | Miksovsky et al. | |

(Continued)

OTHER PUBLICATIONS

NEW capCAP, www.humangear.com/gear/capcap, downloaded Feb. 7, 2017, 10 pages.

*Primary Examiner* — Jes F Pascua
(74) *Attorney, Agent, or Firm* — Klarquist Sparkman LLP

(57) ABSTRACT

Disclosed herein are fluid bladders that include a port and a port closure, a handle, and/or other components. Some disclosed closures can be configured to provide at least two different sized openings for accessing the reservoir, as well as providing a sealing and/or locking mechanism to close the port and seal the port. Exemplary closures comprising a base defining a fill port and mounted to a wall of the bladder, a first cap component that is attached to the base, and a second cap component (e.g., a lid) that is attachable and detachable (via threaded engagement, a pivoting snap fit, or otherwise) to the first cap component. The base can be fixed (e.g., welded) to the bladder to cover the bladder wall opening and provide a second, rigid opening, or port. The first cap component is coupled to the base and can overlie the port or be positioned around the port (optionally providing a third, smaller opening), and the second cap component can cover the first cap component to completely seal off the port and prevent fluid passage in or out of the bladder. The first cap component can include a lid release and locking mechanism.

20 Claims, 15 Drawing Sheets

(56) References Cited

U.S. PATENT DOCUMENTS

| | | | | |
|---|---|---|---|---|
| 2007/0095864 | A1* | 5/2007 | Vangeel | B65D 47/0828 222/556 |
| 2012/0145713 | A1* | 6/2012 | Jung | A47J 41/0011 220/254.3 |
| 2016/0355305 | A1* | 12/2016 | Hoskins | B65D 47/066 |

* cited by examiner

CLOSURES FOR BLADDER PORTS

CROSS-REFERENCE TO RELATED APPLICATIONS

This application claims the benefit of U.S. Provisional Application No. 62/172,967, filed on Jun. 9, 2015, and entitled "DUAL OPENING CAPS FOR BLADDERS," which is incorporated by reference herein in its entirety.

FIELD

This disclosure relates to closure for bladder ports, such as dual-cap closures and locking closures.

SUMMARY

Disclosed herein are fluid bladders or other fluid containers that include one or more ports for conducting fluid and/or other objects into and out of the bladder. Also disclosed herein are various port closures, handles, and other components of or for use with such fluid reservoirs. Some disclosed closures can be configured to provide at least two different openings for accessing the internal volume of the reservoir through a port, as well as providing a sealing and/or locking mechanism to close the port and seal the port.

For example, some disclosed embodiments include a bladder and a closure comprising a base with a fill port mounted to a wall of the bladder, a first cap component that is attachable and detachable (via threaded engagement, a snap fit, or otherwise) to the fill port, and a second cap component (e.g., a lid) that is attachable and detachable (via threaded engagement, a snap fit, or otherwise) to the first cap component. The opening in the flexible bladder wall can have a large cross-sectional area, the base can be fixed (e.g., welded) to the bladder to cover the bladder wall opening and provide a second, rigid opening, or port. The first cap component is coupled to the base and can overlie the port or be positioned around the port (optionally providing a third, smaller opening), and the second cap component can cover the first cap component to completely seal off the port and prevent fluid passage in or out of the bladder.

In some embodiments, the second cap component can pivot relative to the first cap component to open and close the port, while in other embodiments the second cap component can rotate relative to the first cap component to open and close the port.

In some embodiments, the base or the first cap component includes a locking mechanism that prevents the first or second cap component from pivoting open. The pivoting component can include a latch or other engagement member that engages with an opening or other engagement member in a stationary component to hold the pivoting component in the closed position. When unlocked, a release actuator can be pressed by a user to release the pivoting component to pivot open. When the locking mechanism is engaged, the release actuator can be disabled. The locking mechanism can comprise, for example, a curved slider that slides behind a release button to prevent the release button from being depressed.

In some embodiments, the fluid container includes a handle that is integral with and/or extends from the closure (e.g., from the base or from the first cap component). In other embodiments, the fluid container includes a handle fixed directly to the bladder wall and spaced apart from the closure.

The foregoing and other objects, features, and advantages of the disclosed technology will become more apparent from the following detailed description, which proceeds with reference to the accompanying figures.

DETAILED DESCRIPTION

Figure 1B:
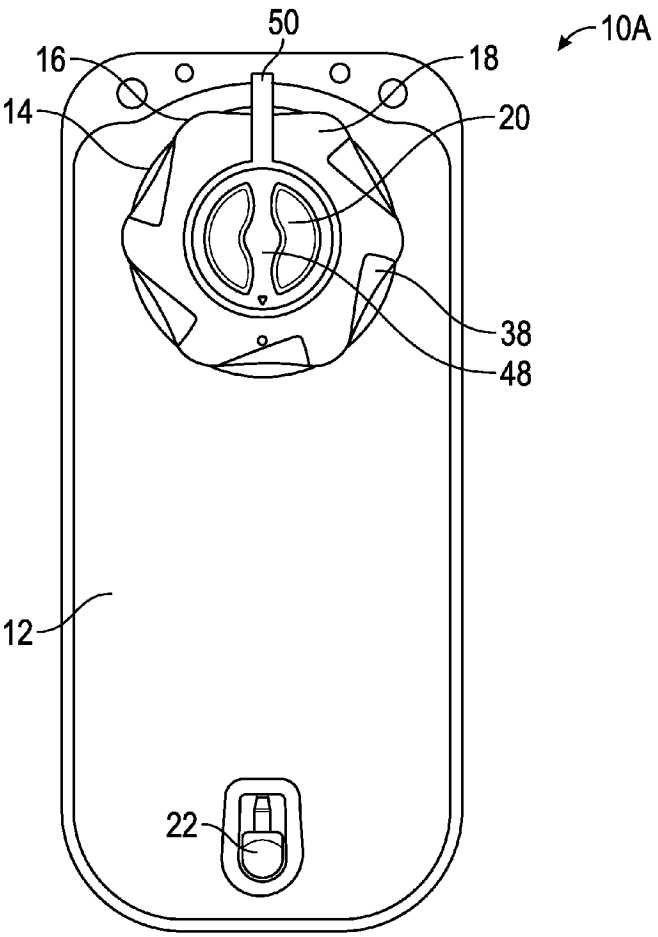
FIG. 1B shows an exemplary fluid bladder comprising a dual opening cap and no handle.
Figure 1A:
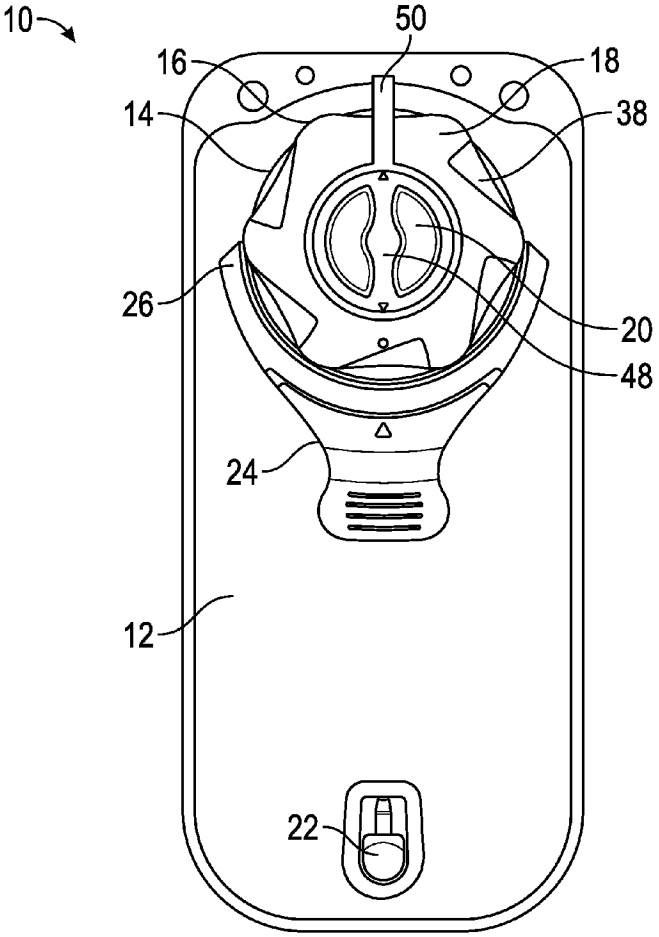
FIG. 1A shows an exemplary fluid bladder comprising a dual opening cap and a handle.
Figure 2B:
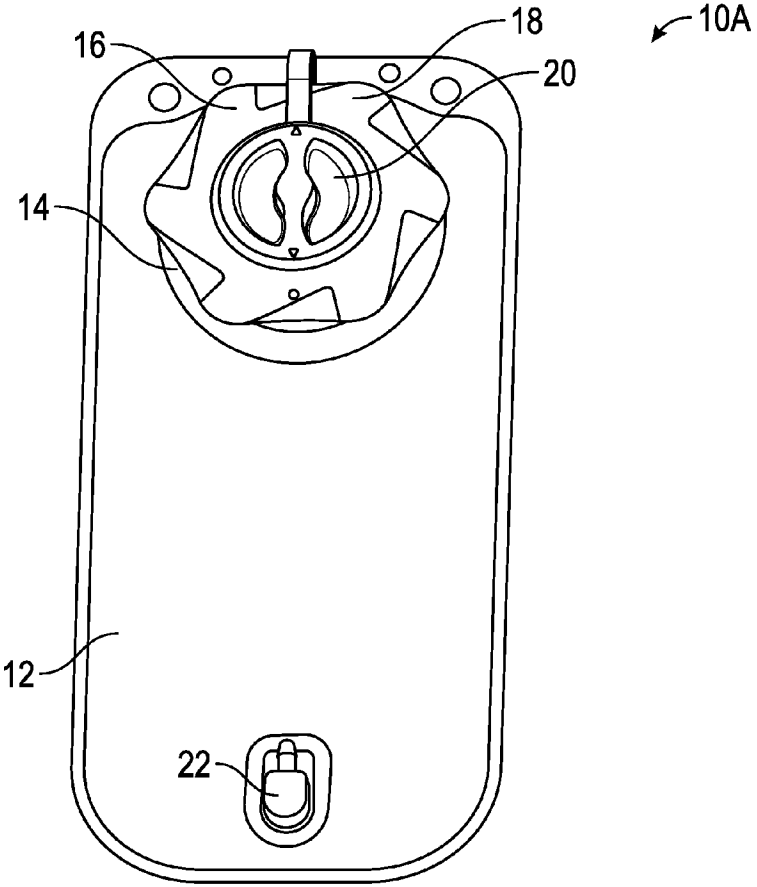
FIGS. 2A and 2B are perspective views of the bladders of FIGS. 1A and 1B, respectively.
Figure 2A:
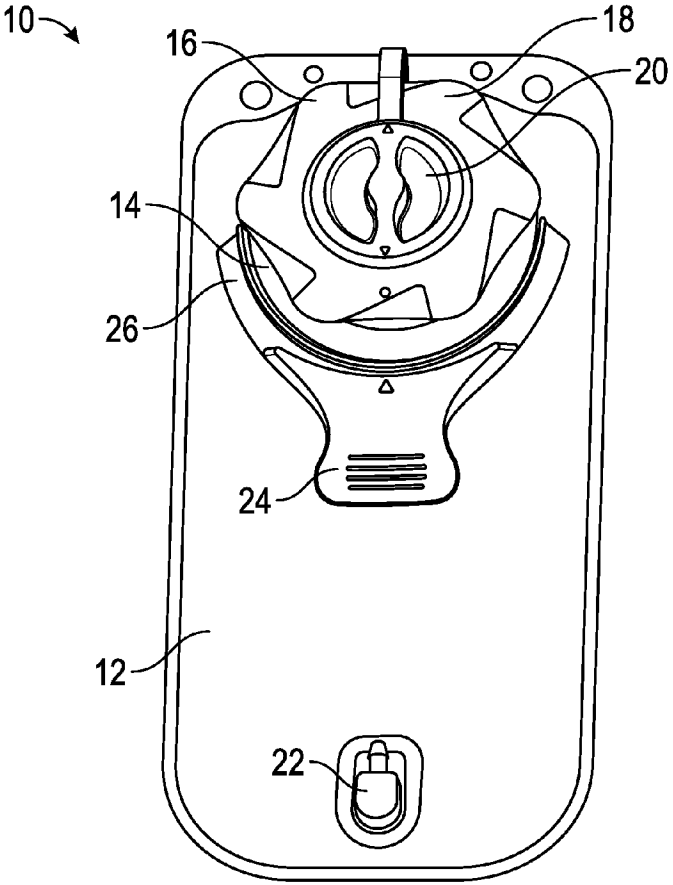
Figure 3A:
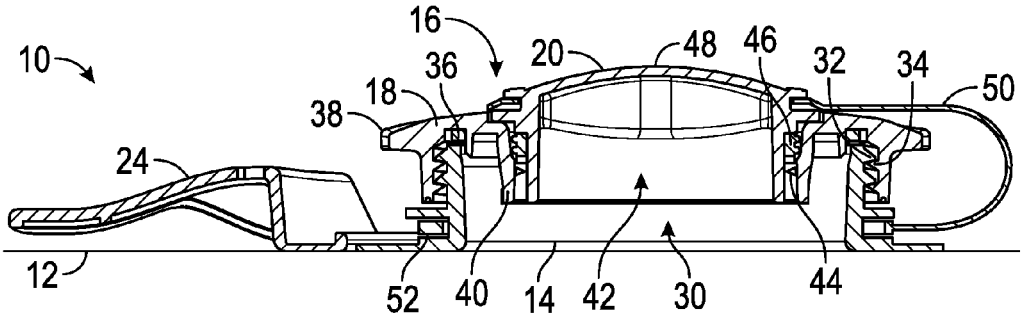
FIGS. 3A and 3B are cross-sectional views of the bladder with a dual opening cap attached, with and without a handle, respectively.
Figure 3B:
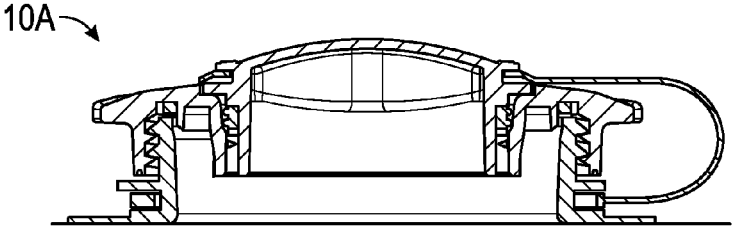
Figure 3C:
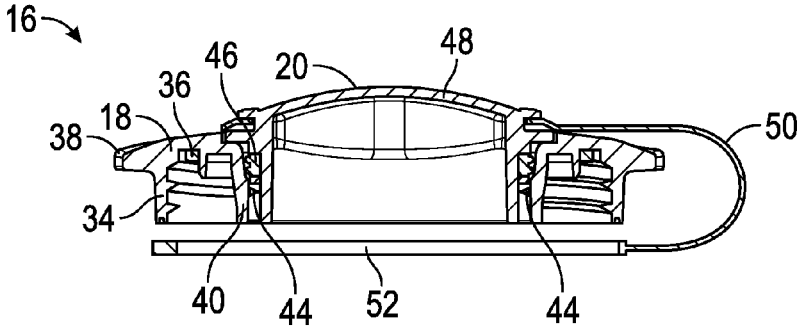
FIG. 3C is a cross-sectional view of the dual opening cap with its tether.
Figure 4A:
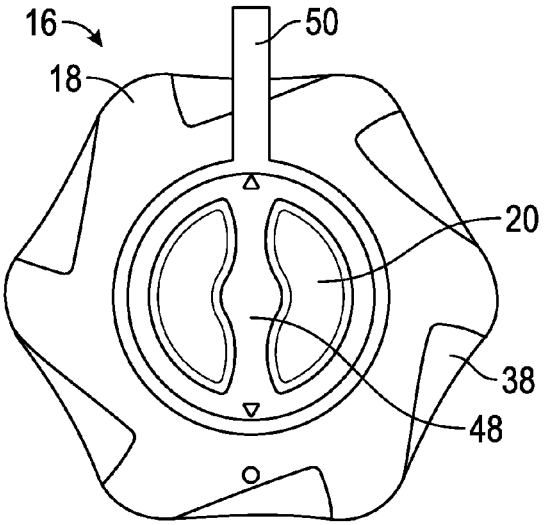
FIG. 4A is a top view of the dual opening cap and tether.
Figure 4B:
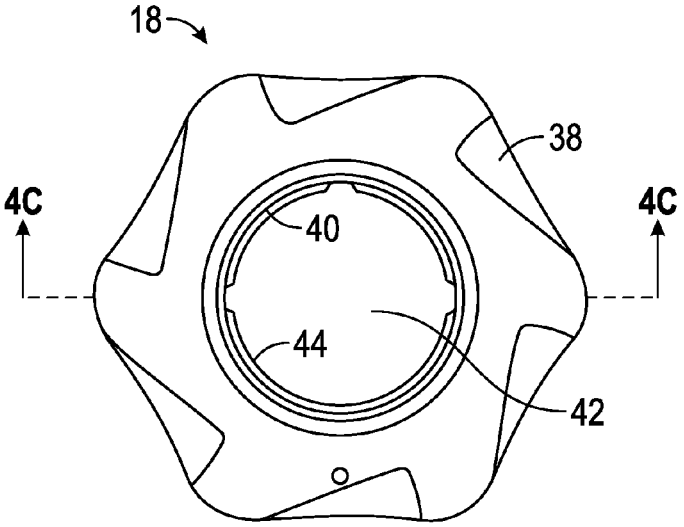
FIGS. 4B and 4C are top and cross-sectional views of an outer component of the dual opening cap.
Figure 4C:
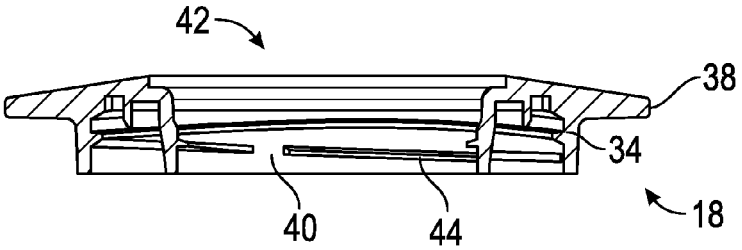

FIGS. 1A, 2A, and 3A show an exemplary fluid bladder 10 comprising a flexible bladder wall 12 with a fill port 14 and handle 14 fixed thereto and a dual opening cap 16 coupled to the fill port. FIGS. 1B, 2B, and 3B show an alternative fluid bladder 10A that is similar to the embodiment 10 but without the handle 14. FIGS. 3C and 4A show just the dual opening cap 16 with a tether 50. The cap 16 comprises a first cap component, or outer cap, 18 and a second cap component, or inner cap, 20. FIGS. 4B and 4C show just the outer cap 18. The outer cap 18 is threadably attachable and detachable to the fill port 14, and the inner cap 20 is threadably attachable and detachable to the outer cap 18. While the embodiments disclosed herein are primarily discussed in conjunction with a fluid bladder having a flexible side wall to which the fill port is secured, the disclosed embodiments can also be used with other types of fluid reservoirs, such as a rigid bottle or a flexible bladder with the fill port mounted at a top opening rather than in a side wall.

The fill port 14 is annular and defines a large opening 30 that passes through the bladder wall 12. The large opening 30 can have any size, such as a circular cross-section having a diameter of about 80 mm. The cap 16 covers and seals off the large opening 30 when the cap 16 is attached to the fill port and the inner cap 20 is attached to the outer cap 18. When the cap 16 is removed, the large opening 30 through the fill port 14 can be used to clean the inside of the bladder, add ice cubes into the bladder, etc.

The outer cap 18 is annular and defines a small opening 42 that has a cross-sectional area that is smaller than that of the large opening 30. For example, the small opening 42 can have a circular cross-section having a diameter that is less than 80 mm, less than 70 mm, less than 65 mm, less than 60 mm, and/or about 63 mm. The inner cap 20 covers and seals off the small opening 42 in the outer cap. When the outer cap 18 is attached to the fill port 14 and the inner cap 20 is removed, the small opening 42 can be used to add fluid into the bladder while the outer rim 38 of the outer cap can be used to hold the bladder. The outer rim 38 can project radially outwardly and form a recess underneath the rim in which a user can place her fingers to securely grasp the bladder while filling through the small opening 42. In the embodiment 10, the handle 24 can also be used to hold the bladder while filling through either the large opening or the small opening.

The outer cap 18 can include inner threads 34 that engage with outer threads 32 on the fill port. The outer cap 18 can also include a gasket 36 to seal the engagement between the fill port and the outer cap to prevent leakage therebetween. Similarly, the inner cap 20 and the outer cap 18 can include mating threads 44 and a gasket 46 to seal around the perimeter of the small openings 42. The outer rim 38 of the outer cap 18 can include notches or recesses that help provide grip to rotate the outer cap relative to the fill port 14 and to provide counter-traction while rotating the inner cap 20 relative to the outer cap. Similarly, the inner cap 20 can include a grip 48 for applying torque to the inner cap.

The inner cap 20 can also be attached to the fill port 14 via a tether 50 that includes a ring 52 that extends around the fill port. When the entire cap 16 is removed from the fill port 14, the tether retains the entire cap, and when the inner cap 20 is removed from the outer cap 18, the tether retains just the inner cap.

Figure 5A:
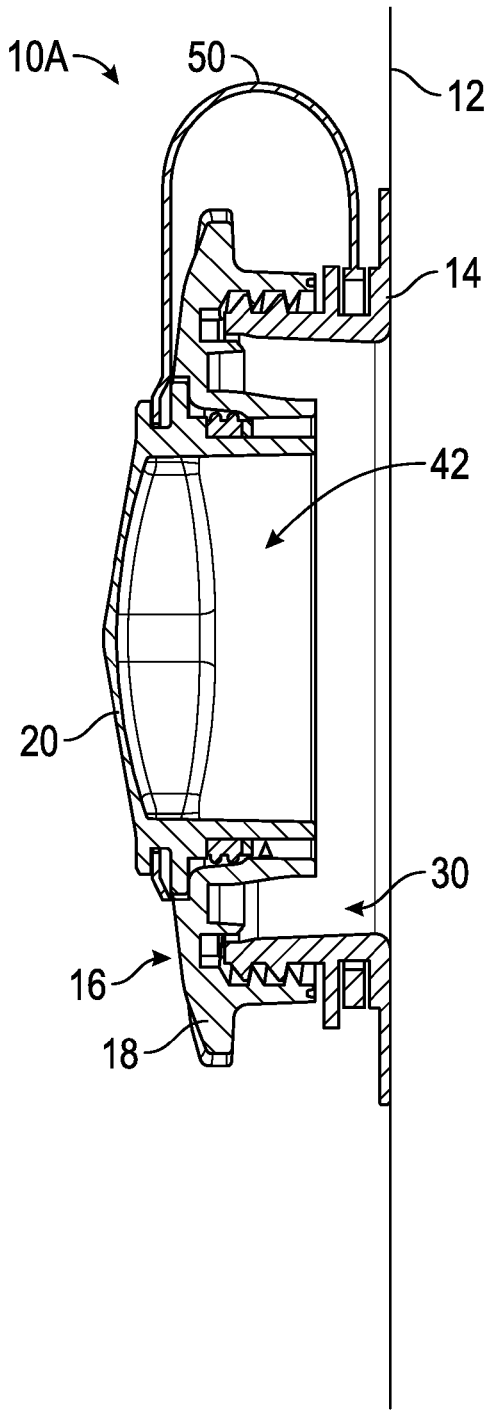
FIGS. 5A-5C are views of the bladder with the dual opening cap.
Figure 5C:
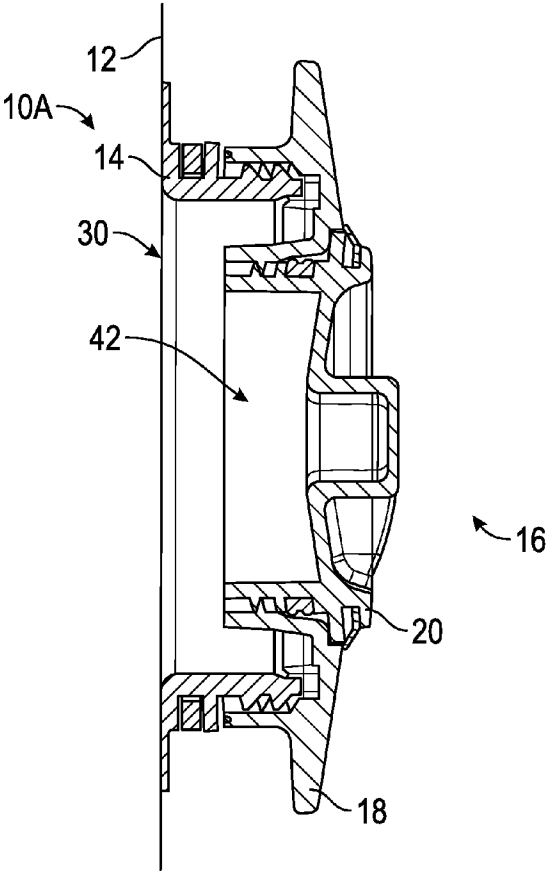
Figure 5B:
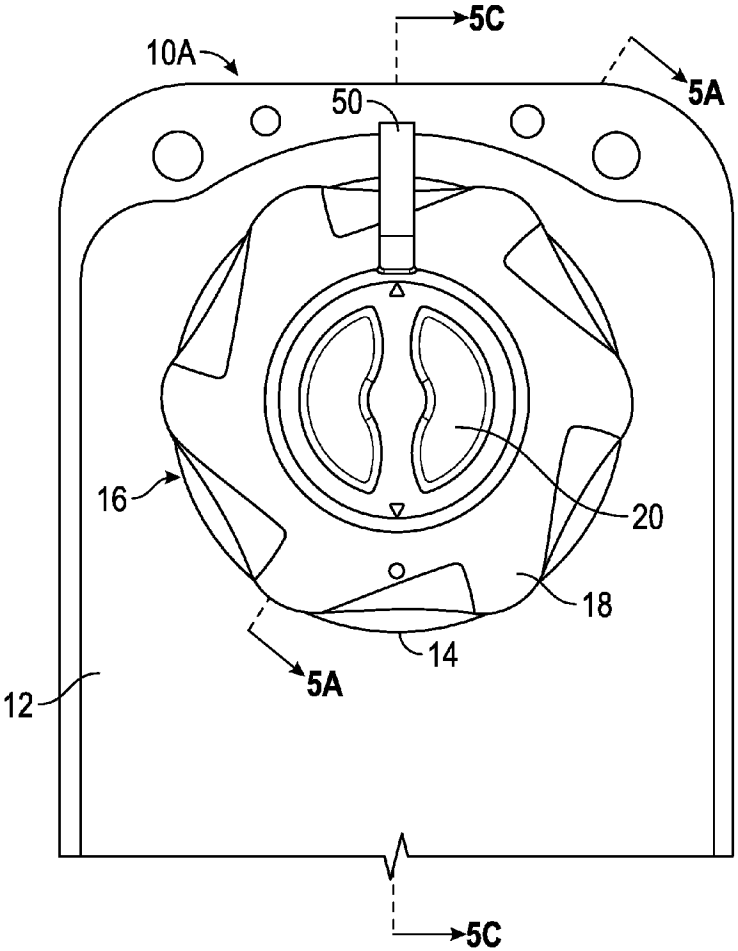

FIGS. 5A-5C shows views of one embodiment of the bladder 10A with exemplary dimensions, provided in millimeters.

FIGS. 6A-8B shows another exemplary dual opening cap 62 with a fill port 60 for a bladder (not shown). The fill port 60 defines a large opening 70 for cleaning/filling the bladder. The fill port 60 and large opening 70 can have properties similar to the fill port 14 and large opening 30. The cap 62 comprises an outer cap component, or outer cap 64, and an inner cap component, or inner cap, 66 that are pivotably coupled together at hinge 68. The outer cap 64 can include inner threads 92 and a gasket 94 (FIG. 7B) that engage with and seal against the annular rim of the fill port 60.

Figure 6A:
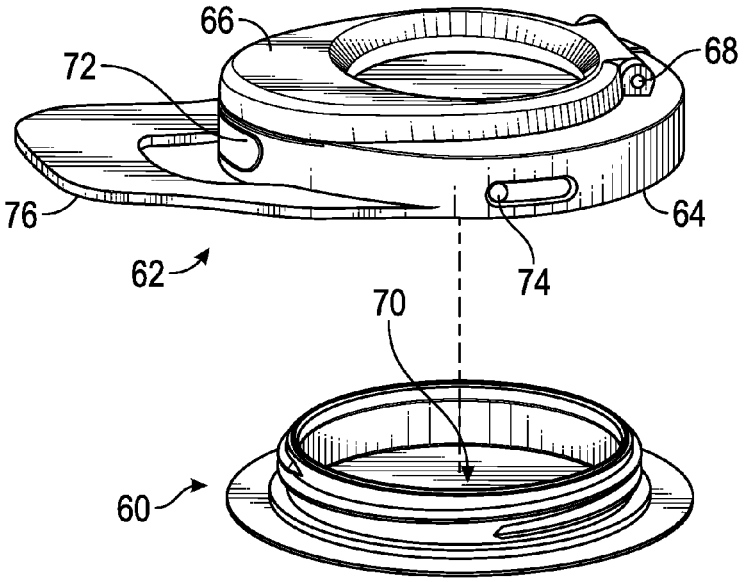
FIG. 6A is a partially exploded view of an exemplary fill port and dual opening cap, in a closed, locked position.
Figure 6B:
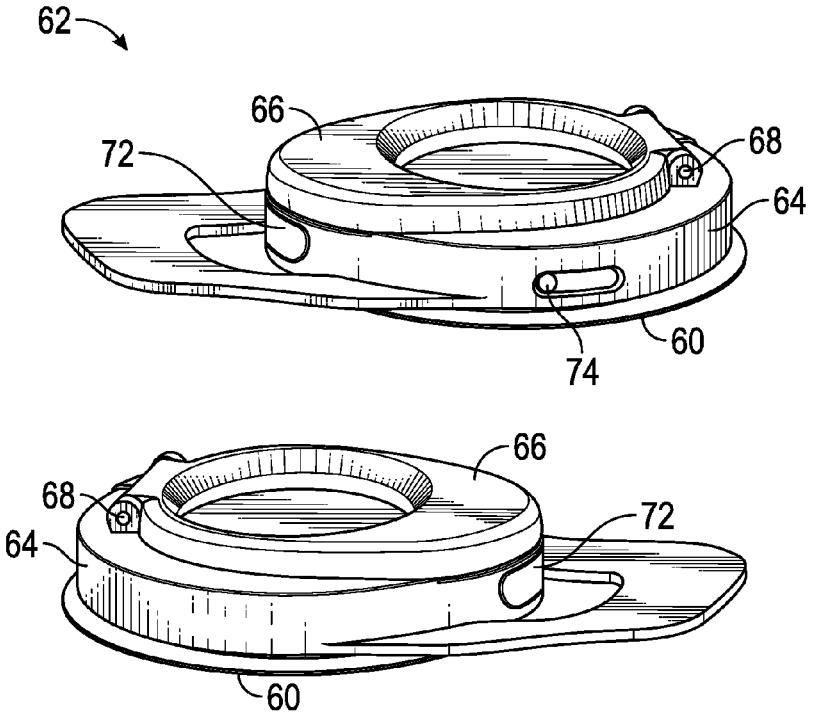
FIG. 6B shows two views of the fill port and cap of FIG. 7A in the closed, locked position.
Figure 6C:
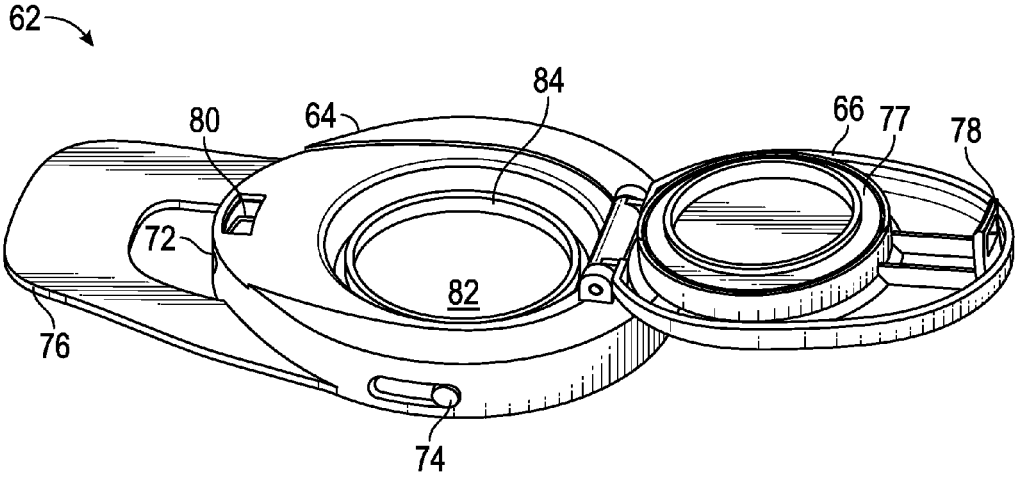
FIG. 6C shows the dual opening cap of FIG. 7A in an unlocked, open position.
Figure 7A:
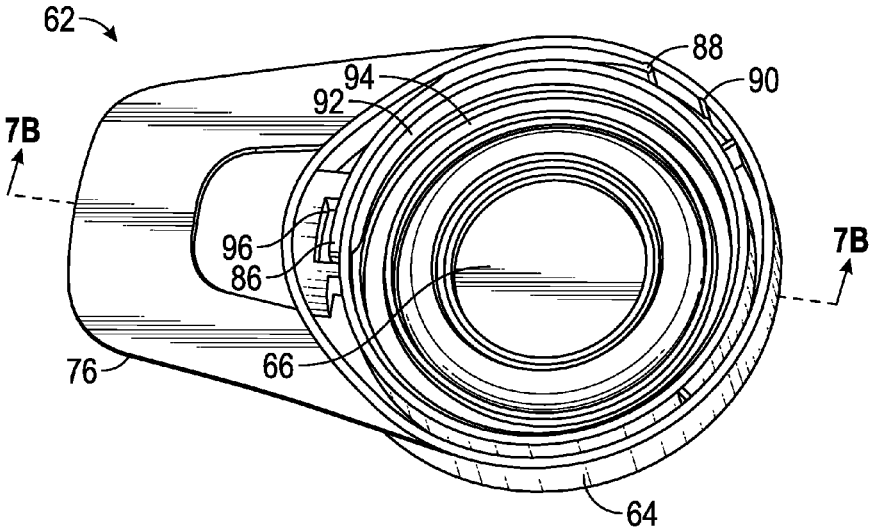
FIG. 7A is a bottom view of the dual opening cap in a closed, locked position.
Figure 7B:
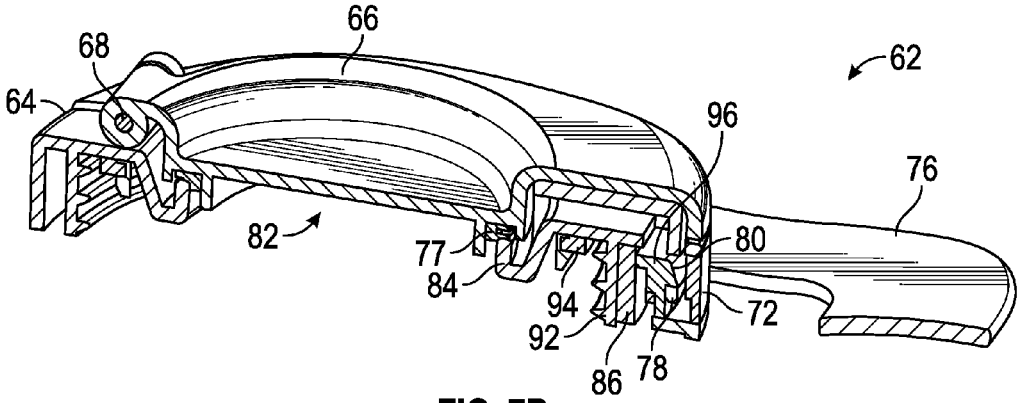
FIG. 7B is a cross-sectional view of the dual opening cap in the closed, locked position.
Figure 8A:
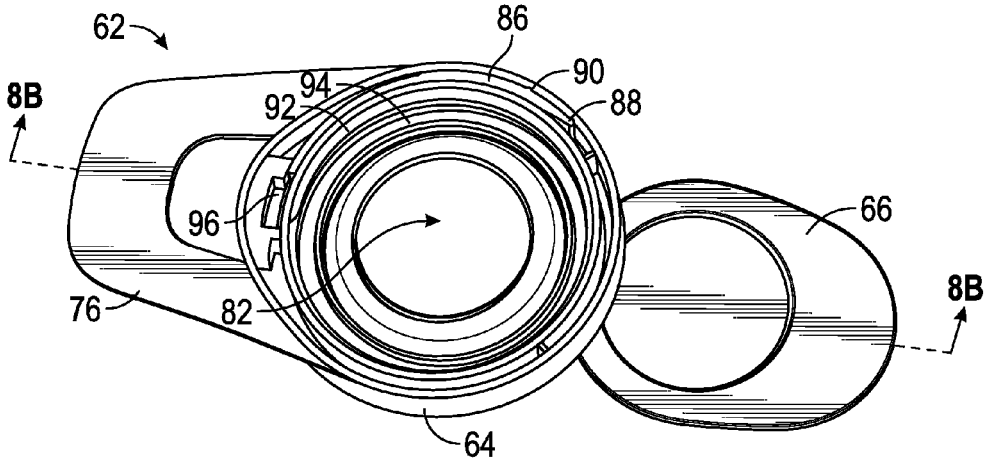
FIG. 8A is a bottom view of the dual opening cap in the unlocked, open position.
Figure 8B:
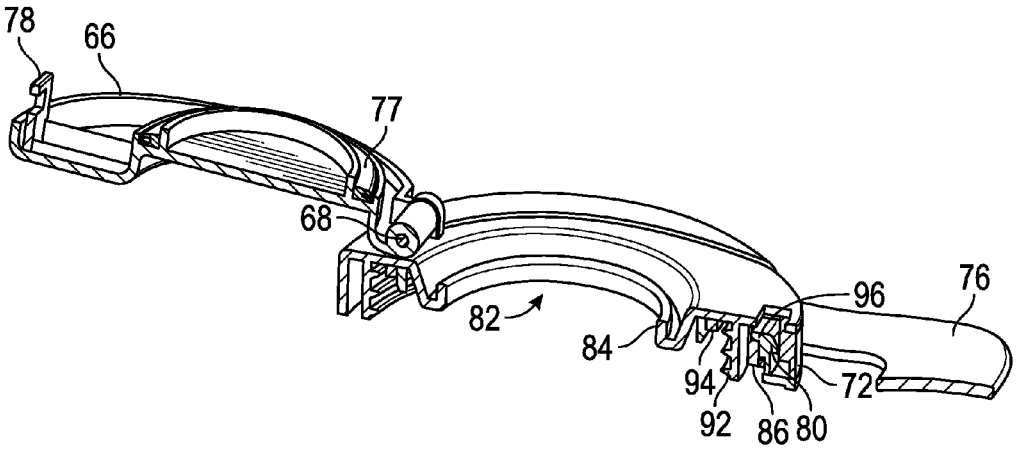
FIG. 8B is a cross-sectional view of the dual opening cap in the unlocked, open position.
Figure 9A:
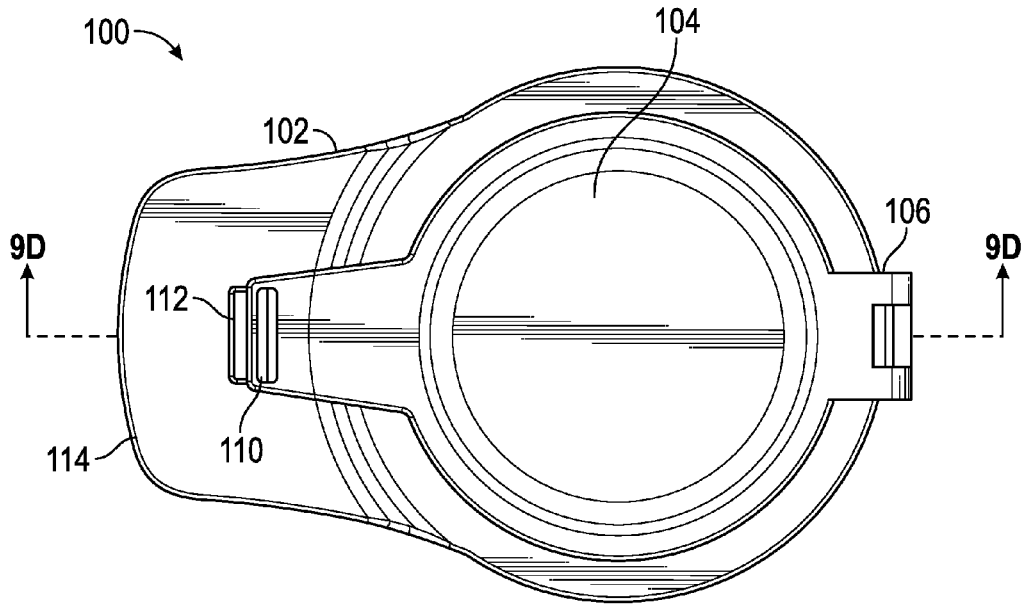
FIGS. 9A-9D are various views of another exemplary fill port and snap cap.
Figure 9B:
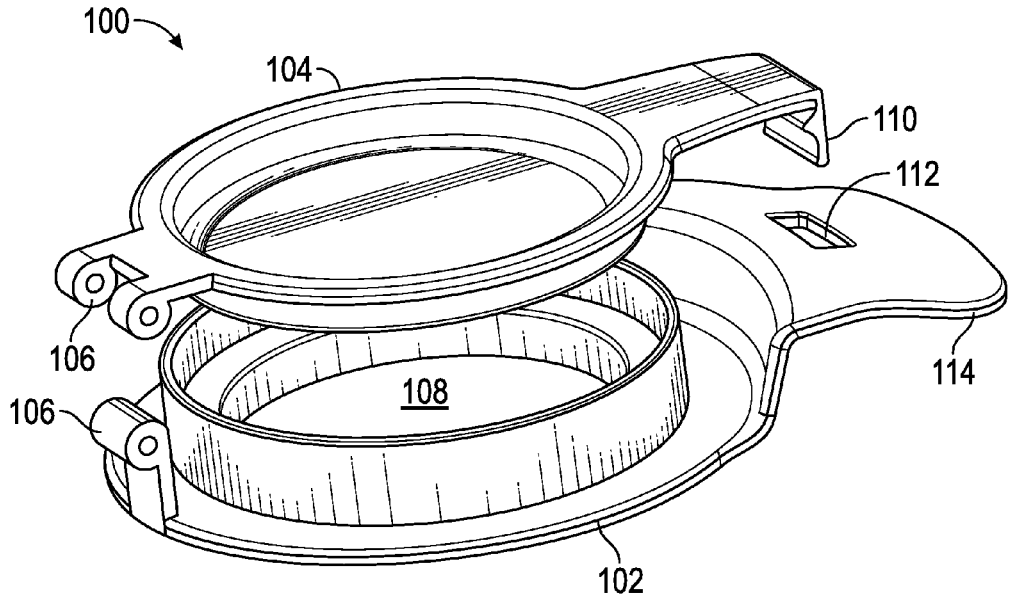
Figure 9C:
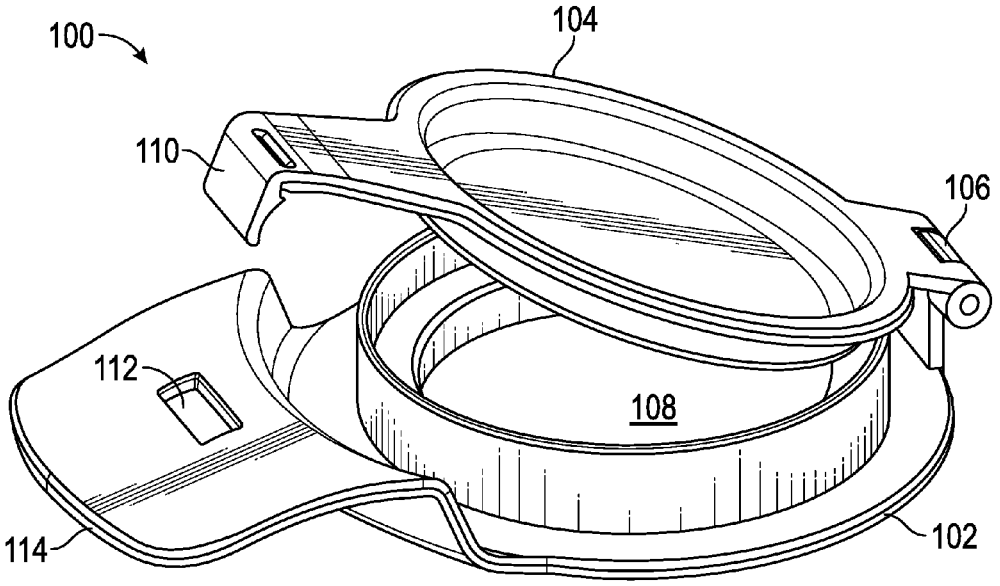
Figure 9D:
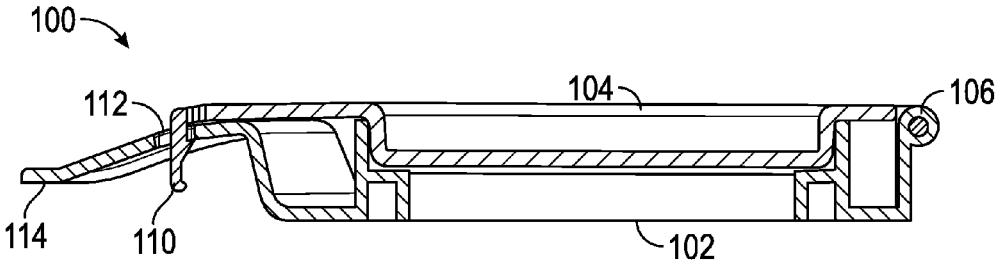
Figure 11:
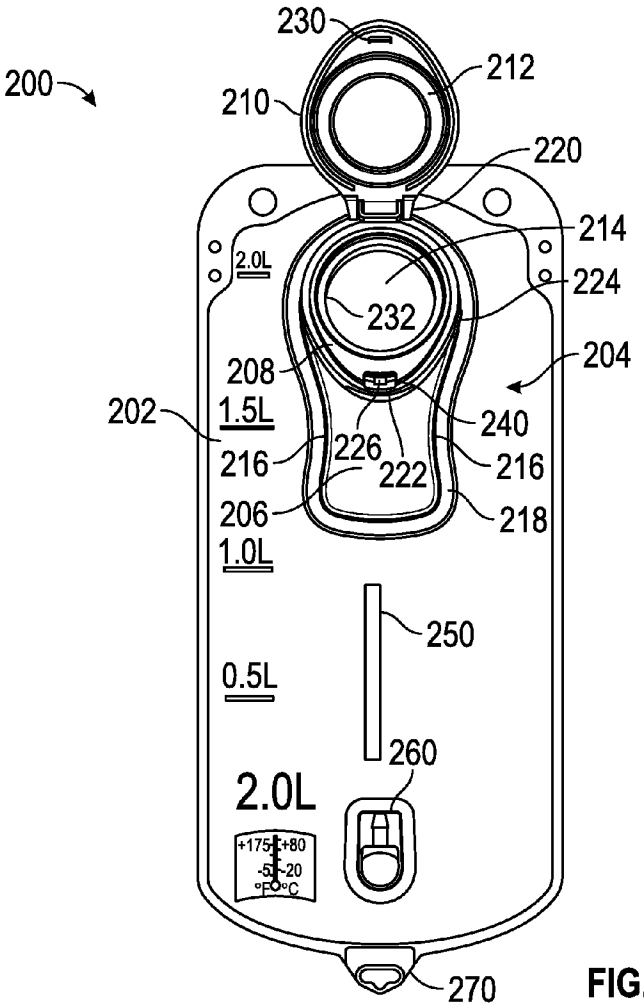
FIG. 11 shows the fluid bladder of FIG. 10 with the fill port lid pivoted open.
Figure 10:
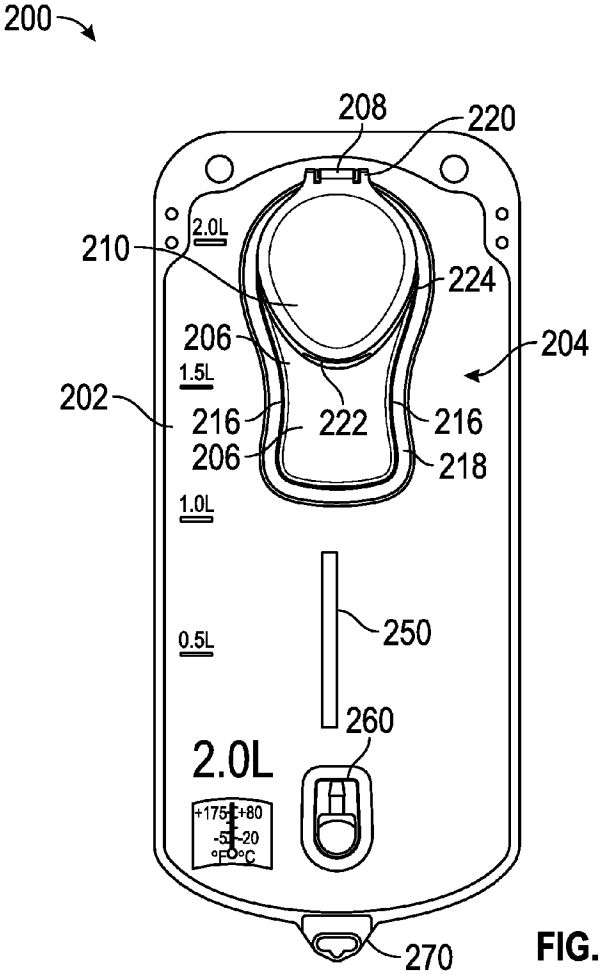
FIG. 10 shows an exemplary fluid bladder with a fill port closure having a contoured handle integral with the port base and a pivoting lid that locked in a closed position.
Figure 13:
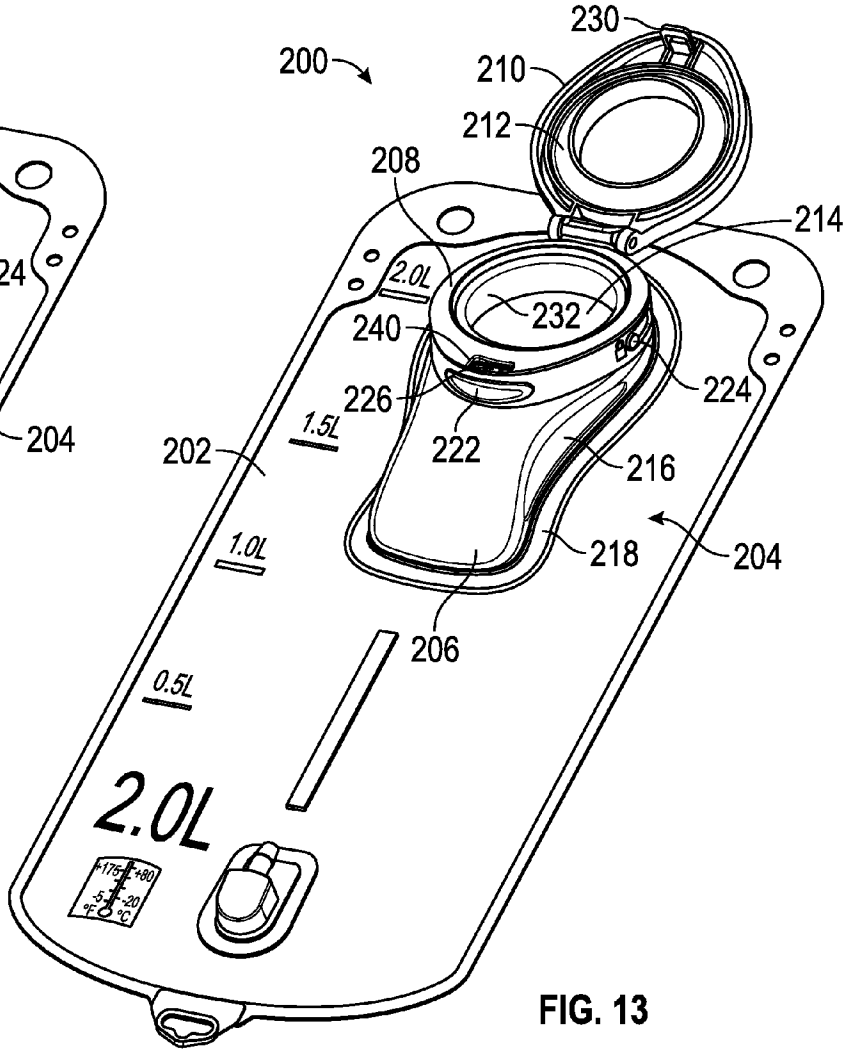
FIG. 13 is a perspective view of FIG. 11.
Figure 12:
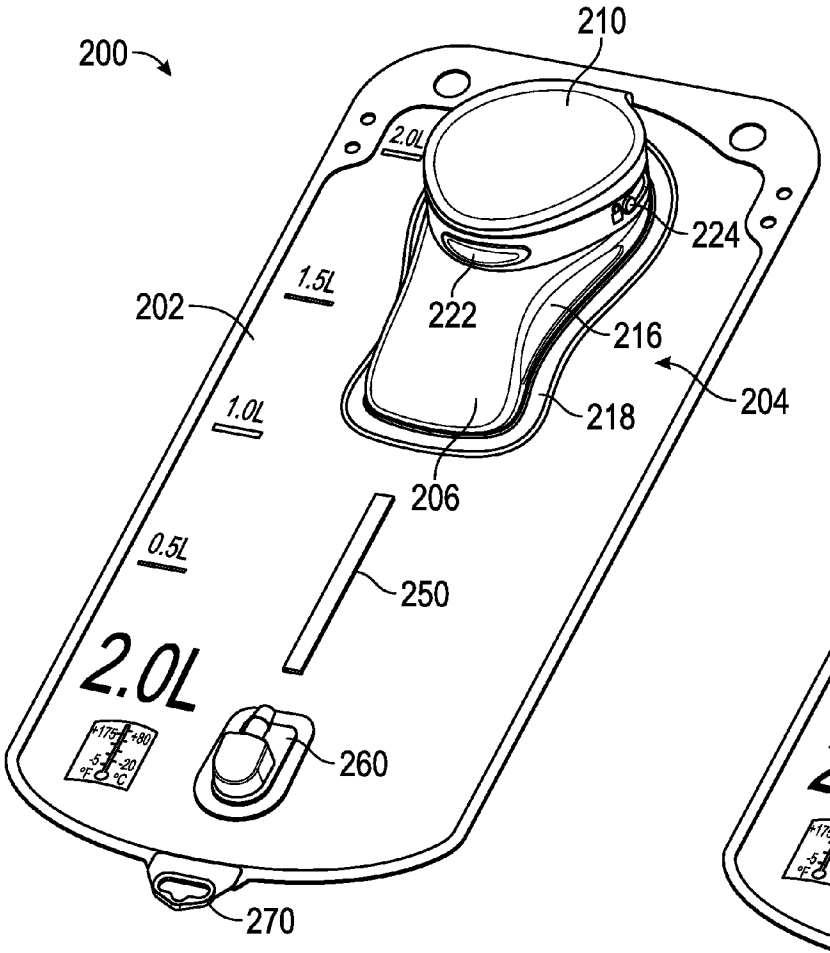
FIG. 12 is a perspective view of FIG. 10.
Figure 14:
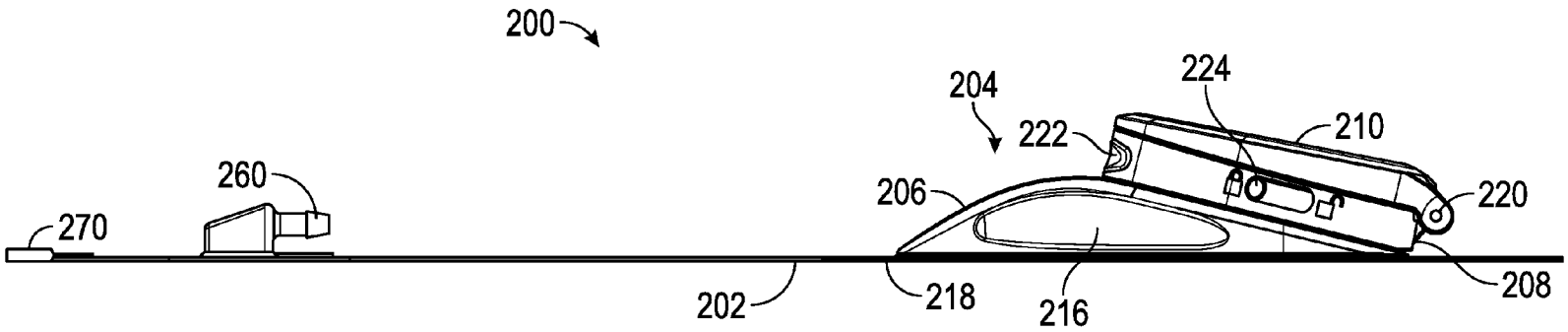
FIG. 14 is a side view of FIG. 10.

The inner cap 66 has a closed position shown in FIGS. 6A, 6B, 7A, and 7B, and an open position shown in FIGS. 6C, 8A, and 8B. In the closed position, the inner cap 66 seals off a small opening 82 defined in the outer cap 64. The small opening 82 can have dimensions similar to those provided for the small opening 42. The inner cap 66 can include a gasket 77 that seals against an inner rim 84 of the outer cap when the inner cap is in the closed position.

The inner cap 66 includes a tab 78 that engages with a release mechanism 72 in the outer cap. The release mechanism 72 can include an upper opening 80 (FIG. 6C) that receives the tab 78 and secures the inner cap in the closed position. A user can then press the release mechanism 72 inwardly to release the tab 78 and allow the inner cap to pivot open (e.g., via a biasing mechanism or manually).

The outer cap 64 can also include a locking mechanism 86 that can be manually moved between a locked position (FIGS. 6A, 6B, 7A and 7B) and an unlocked position (FIGS. 6C, 8A, and 8B). The locking mechanism can comprise a curved, sliding member that can be moved circumferentially along a slot in the outer cap 64. As illustrated in FIGS. 7A and 7B, with the locking mechanism 86 in the locked position, an inner portion 96 of the release mechanism 72 is blocked by the member 86 to prevent the release mechanism from being depressed radially inwardly, thereby preventing the tab 78 from being released from the release mechanism and preventing the inner cap 66 from pivoting up to open the small opening 82. As illustrated in FIGS. 8A and 8B, when the locking mechanism 86 is in the unlocked position, the release mechanism can be depressed to release the inner cap. The locking mechanism can include indexing/biasing features, such as grooves 90 in the outer cap and ridge 88 in the sliding locking mechanism member. The ridge 88 can snap into one groove 90 in the locked position and snap into the other groove 90 in the unlocked position. As shown in FIG. 6C, the locking mechanism can also include an actuator 74 that projects through an lateral opening in the outer wall of the outer cap 64 to allow a user to manually move the locking mechanism 86 between the locked and unlocked positions.

The dual opening cap 62 can allow a user to hold and operate the bladder with one hand, such as by using her thumb to press on the release mechanism 72 and using her finger to actuate the locking mechanism actuator 74. The outer cap 64 can also include a handle 76 to hold the bladder with the inner cap open or closed.

FIGS. 9A-9D illustrate another exemplary fill port closure 100, which comprises a fill port 102 and a cap 104 that is pivotably coupled to the fill port at hinge 106. The cap 104 seals off opening 108 in the fill port when the cap is closed. In the closed position, a tab 110 projecting forward from the cap passes through an opening 112 in a handle 114 of the fill port and engagement features for a locking mechanism between the tab 110 and the opening 112 (see FIG. 9D). The cap can snap closed by applying sufficient pressure. To open the cap 104, a user can resiliently deform the tab 110 by pulling it radially outwardly a small distance such that it can clear the edges of the opening 112 can move back up through the opening. Other types of locking/release mechanisms can also be used alternatively or in addition. The cap 104 can comprise a recessed central region that sits within a rim of the fill port and seals against a lower inner surface of the fill port surrounding the opening 106, optionally with a gasket therebetween. In some embodiments not shown, the cap 104 can include a smaller second opening (e.g., in the center of the cap 104) and a secondary cap that is attachable to the cap 104 to seal off the second opening, wherein the secondary cap can be opened and/or removed from the cap 104 to access the second opening.

FIGS. 10-16 illustrate an exemplary fluid container 200 comprising a flexible bladder 202 and a closure 204 secured to the bladder over an opening in the wall of the bladder. The container can also include a center weld 250 to maintain a flat shape of the bladder and/or an exit port 260 that is coupleable to a drink tube and/or bite valve.

The closure 204 can comprise a base 206 secured to the bladder around the bladder opening, the base having a port 214 to allow passage of fluid through the base in or out of the bladder. The closure can further comprise an annular cap retainer 208 secured to the base 206 around an annular wall 232 defining the port 214 and a cap 210 hingedly coupled to the cap retainer via hinge 220 and pivotable between a closed position (FIGS. 10, 12, 14-16) where the cap seals the port 214 closed and an open position (FIGS. 11 and 13) where the port is open for passage of fluid in or out of the bladder.

The base 206 can further define a shaped, contoured handle portion 216 positioned adjacent to the port 214 such that the fluid container 200 can be held by the handle while filling the bladder through the port. The handle 216 can, for example, include concave portions of the base and/or ridges/bumps/grooves in the surface of the base to provide a gripping location.

The cap retainer 208 comprises a retainer mechanism 226 that engages and secures an engagement member 230 (e.g., a flange or latch) of the cap 210 in the closed position, and a release actuator 222 (e.g., a push button) that disengages the cap engagement member from the retainer mechanism when actuated by a user. The cap retainer 208 can further comprise a locking mechanism that is adjustable between a locked position (FIG. 16) wherein the release actuator is disabled and an unlocked position wherein the release actuator is enabled. The locking mechanism can include a curved member 228 (FIG. 15) mounted in the cap retainer 208 that slides behind the retainer mechanism 226 when an actuator 224 (FIG. 16) is moved to the locked position. In the locked position, curved member 228 is behind the retainer mechanism 226 and prevents it from moving back when the release actuator 222 is pressed, thereby disabling the cap release mechanism. When the actuator 224 is slid over to the unlocked position, the curved member 228 moves out from behind the retainer mechanism 226 and allows the release actuator 222 to be depressed to release the cap 210 to open.

Figure 15:
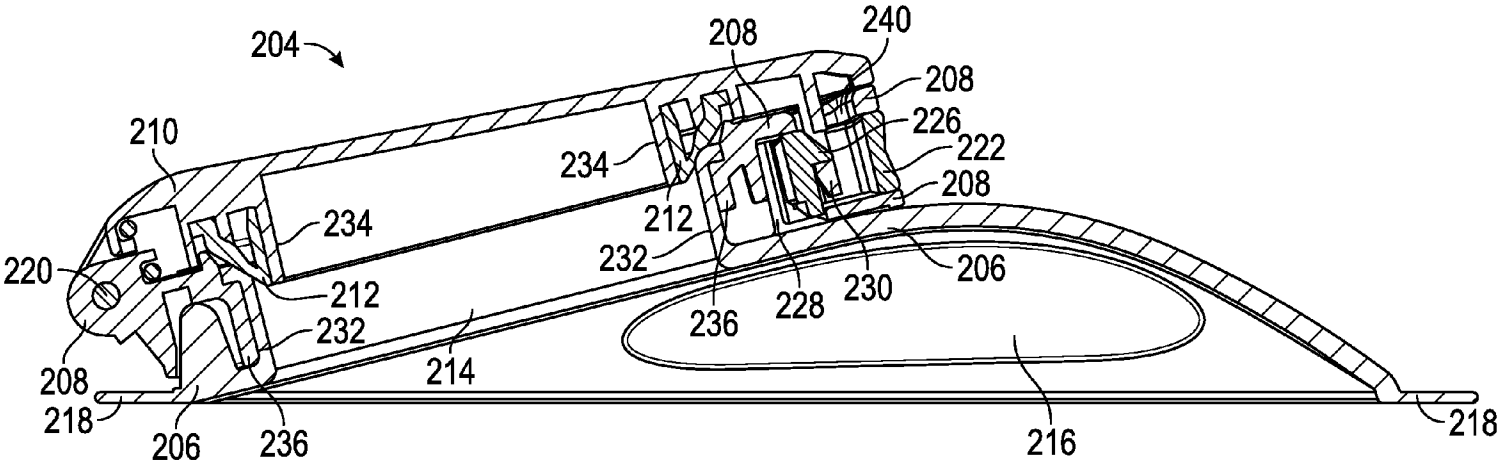
FIG. 15 is a cross-sectional side view of the closure of FIGS. 10-14 in the closed position.
Figure 16:
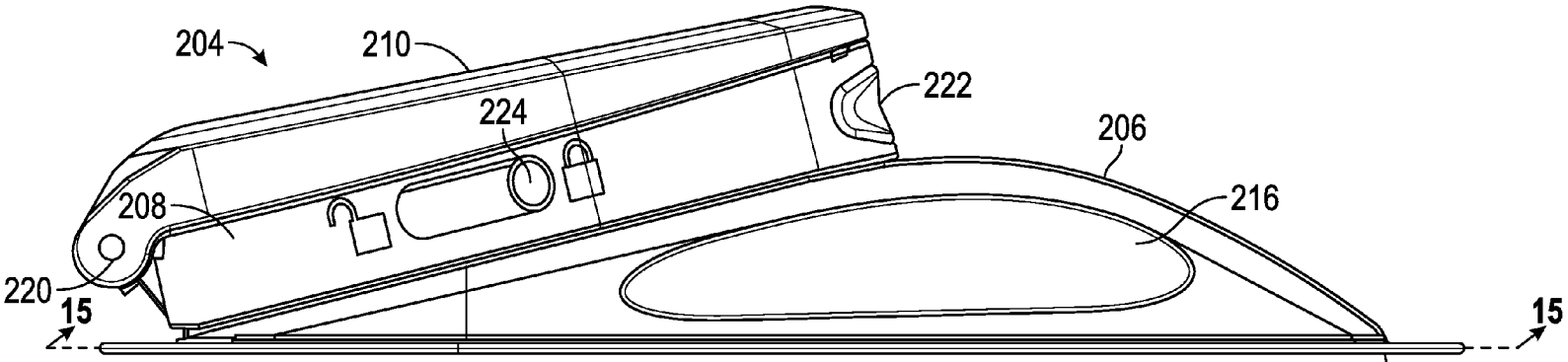
FIG. 16 is an external side view of the closure of FIGS. 10-14 in the closed position, showing a manual actuator for a cap locking mechanism.

As shown in FIG. 15, the cap retainer 208 can be permanently or semi-permanently secured to the base 206 with an inner annular wall 236 of the cap retainer mounted around the outside of the port wall 232. The port wall 232 can include an outwardly turned upper flange that engages the inner annular wall 236 and secures cap retainer to the base. In other embodiments, the cap retainer 208 can be detachable and reattachable to the base, such as via a threaded or snap-fit connection to the base.

In some embodiments, the closure 204 can include a spring or other biasing mechanism to urge the cap 210 toward the open position, sufficient such that when the release actuator 222 is pressed, the lip flips to the open position.

The closure 204 can also include one or more gaskets or other sealing members to prevent leaks. For example, an annular gasket 212 can be coupled to the underside of the cap 210 to seal joint between the cap and the port wall 232. The cap 210 can include an annular projection 234 that enters inside the port wall 232 and squeezes the gasket between the projection 234 and the port wall 232. The gasket 212 can also seal against an annular surface of the cap retainer in some embodiments for additional leak protection. Additional gaskets, O-rings, or other seals, can also be included, such as at the juncture between the base 206 and the cap retainer.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

Numerical values, characteristics, materials, and other features described in conjunction with a particular aspect, embodiment, or example of the disclosed technology are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

Although the operations of some of the disclosed methods are described in a particular, sequential order for convenient presentation, it should be understood that this manner of description encompasses rearrangement, unless a particular ordering is required by specific language. For example, operations described sequentially may in some cases be rearranged or performed concurrently. Moreover, for the sake of simplicity, the attached figures may not show the various ways in which the disclosed methods can be used in conjunction with other methods.

As used herein, the terms "a", "an", and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A", "B,", "C", "A and B", "A and C", "B and C", or "A, B, and C." As used herein, the term "coupled" generally means physically coupled or linked and does not exclude the presence of intermediate elements between the coupled items absent specific contrary language.

In view of the many possible embodiments to which the principles of the disclosed technology may be applied, it should be recognized that the illustrated embodiments are only examples and should not be taken as limiting the scope of the disclosure. Rather, the scope of the disclosure is at least as broad as the following claims. I therefore claim all that comes within the scope of the following claims.

The invention claimed is:

1. A fluid container comprising:

a flexible bladder having an internal region for storing a fluid and an opening for allowing passage of fluid in or out of the internal region;

a closure secured to the bladder over the opening of the bladder, wherein the closure comprises:

a base secured to the bladder around the opening, the base having a port to allow passage of fluid through the base in or out of the bladder;

an annular cap retainer secured to the base around the port; and a cap hingedly coupled to the cap retainer and pivotable between a closed position where the cap seals the port closed and an open position where the port is open for passage of fluid in or out of the bladder;

wherein the cap retainer comprises a retainer mechanism that engages and secures the cap in the closed position and a release actuator button that disengages the cap from the retainer mechanism when depressed by a user; and a handle positioned adjacent to the port such that the fluid container can be held by the handle while filling the bladder through the port;

wherein the handle is a portion of the base defining a gripping region.

2. The fluid container of claim 1, wherein the cap retainer comprises a locking mechanism comprising a curved member that is slidably adjustable back and forth between a locked position wherein the release actuator button is disabled by the position of the curved member behind the retainer mechanism and an unlocked position wherein the release mechanism is unimpeded by the curved member and the release actuator button is enabled.

3. The fluid container of claim 2, wherein the locking mechanism further comprises a lock actuator that extends from the curved member at a location spaced apart from the retainer mechanism and the release actuator button, wherein a user can slide the lock actuator to adjust the curved member between the locked position and the unlocked position.

4. The fluid container of claim 1, wherein the gripping region comprises two opposing lateral recesses situated for gripping the handle.

5. The fluid container of claim 1, wherein the retainer mechanism is configured to engage and secure an engagement member of the cap when the cap is in the closed position, and wherein depressing the release actuator button disengages the engagement member from the retainer mechanism and allows the cap to move to the open position.

6. The fluid container of claim 1, wherein the base is secured to a front wall of the bladder and an interface between the base and the front wall of the bladder defines a bladder plane, wherein the port of the base includes an inner circumference that defines a port plane, the port plane being perpendicular to a primary flow direction through the port, and wherein the base is shaped such that the port plane is at an acute angle relative to the bladder plane.

7. The fluid container of claim 1, wherein the handle is fixed to the bladder along an entire length of the handle.

8. A fluid container comprising:

a flexible bladder having an internal region for storing a fluid and an opening for allowing passage of fluid in or out of the internal region;

a closure secured to the bladder over the opening of the bladder, wherein the closure comprises:

a base secured to the bladder around the opening, the base having a port to allow passage of fluid through the base in or out of the bladder;

an annular cap retainer secured to the base around the port; and a cap hingedly coupled to the cap retainer and pivotable between a closed position where the cap seals the port closed and an open position where the port is open for passage of fluid in or out of the bladder;

wherein the cap retainer comprises a retainer mechanism that engages and secures the cap in the closed position and a release actuator button that disengages the cap from the retainer mechanism when depressed by a user; and a handle positioned adjacent to the port such that the fluid container can be held by the handle while filling the bladder through the port;

wherein the base is secured to a front wall of the bladder and an interface between the base and the front wall of the bladder defines a bladder plane, wherein the port of the base includes an inner circumference that defines a port plane, the port plane being perpendicular to a primary flow direction through the port, and wherein the base is shaped such that the port plane is at an acute angle relative to the bladder plane.

9. The fluid container of claim 8, wherein the cap retainer comprises a locking mechanism comprising a curved member that is slidably adjustable back and forth between a locked position wherein the release actuator button is disabled by the position of the curved member behind the retainer mechanism and an unlocked position wherein the release mechanism is unimpeded by the curved member and the release actuator button is enabled.

10. The fluid container of claim 9, wherein the locking mechanism further comprises a lock actuator that extends from the curved member at a location spaced apart from the retainer mechanism and the release actuator button, wherein a user can slide the lock actuator to adjust the curved member between the locked position and the unlocked position.

11. The fluid container of claim 8, wherein the retainer mechanism is configured to engage and secure an engagement member of the cap when the cap is in the closed position, and wherein depressing the release actuator button disengages the engagement member from the retainer mechanism and allows the cap to move to the open position.

12. The fluid container of claim 8, wherein the cap retainer is permanently secured to the base.

13. The fluid container of claim 8, wherein the cap retainer is detachable from the base and the cap retainer is reattachable to the base.

14. The fluid container of claim 8, wherein the handle is fixed to the bladder along an entire length of the handle.

15. A fluid container comprising:

a flexible bladder having an internal region for storing a fluid and an opening for allowing passage of fluid in or out of the internal region;

a closure secured to the bladder over the opening of the bladder, wherein the closure comprises:

a base secured to the bladder around the opening, the base having a port to allow passage of fluid through the base in or out of the bladder;

an annular cap retainer secured to the base around the port; and a cap hingedly coupled to the cap retainer and pivotable between a closed position where the cap seals the port closed and an open position where the port is open for passage of fluid in or out of the bladder;

wherein the cap retainer comprises a retainer mechanism that engages and secures the cap in the closed position and a release actuator button that disengages the cap from the retainer mechanism when depressed by a user; and a handle positioned adjacent to the port such that the fluid container can be held by the handle while filling the bladder through the port;

wherein the handle is fixed to the bladder along an entire length of the handle.

16. The fluid container of claim 15, wherein the cap retainer comprises a locking mechanism comprising a curved member that is slidably adjustable back and forth between a locked position wherein the release actuator button is disabled by the position of the curved member behind the retainer mechanism and an unlocked position wherein the release mechanism is unimpeded by the curved member and the release actuator button is enabled.

17. The fluid container of claim 16, wherein the locking mechanism further comprises a lock actuator that extends from the curved member at a location spaced apart from the retainer mechanism and the release actuator button, wherein a user can slide the lock actuator to adjust the curved member between the locked position and the unlocked position.

18. The fluid container of claim 15, wherein the retainer mechanism is configured to engage and secure an engagement member of the cap when the cap is in the closed position, and wherein depressing the release actuator button disengages the engagement member from the retainer mechanism and allows the cap to move to the open position.

19. The fluid container of claim 15, wherein the cap retainer is permanently secured to the base.

20. The fluid container of claim 15, wherein the cap retainer is detachable from the base and the cap retainer is reattachable to the base.

* * * * *